US011193320B2

(12) United States Patent
Trevarrow et al.

(10) Patent No.: US 11,193,320 B2
(45) Date of Patent: Dec. 7, 2021

(54) WINDOW REGULATOR ASSEMBLY

(71) Applicants: Brose Fahrzeugteile GmbH & Co. Kommanditgesellschaft, Bamberg, Bamberg (DE); GM Global Technology Operations LLC, Detroit, MI (US)

(72) Inventors: James Trevarrow, Sun City West, AZ (US); Jeffrey Murtfeldt, Bloomfield Hills, MI (US); Michael Kidd, Oxford, MI (US); Terrence Costigan, Fenton, MI (US)

(73) Assignees: Brose Fahrzeugteile GmbH & Co. Kommanditgesellschaft, Bamberg, Bamberg (DE); GM Global Technology Operations LLC, Detroit, MI (US)

( * ) Notice: Subject to any disclaimer, the term of this patent is extended or adjusted under 35 U.S.C. 154(b) by 6 days.

(21) Appl. No.: 16/673,496

(22) Filed: Nov. 4, 2019

(65) Prior Publication Data

US 2021/0131159 A1 May 6, 2021

(51) Int. Cl.

| | |
|---|---|
| ***E05D 13/00*** | (2006.01) |
| ***E05F 11/48*** | (2006.01) |
| ***E05D 15/16*** | (2006.01) |

(52) U.S. Cl.

CPC ..... *E05F 11/483* (2013.01); *E05D 15/165* (2013.01); *E05Y 2900/55* (2013.01)

(58) Field of Classification Search

CPC .... B60J 1/17; B60J 1/14; E05F 11/382; E05F 11/385; E05F 11/488; E05F 11/486; E05F 11/485; E05Y 2900/55; E05Y 2201/612; E05Y 2201/64; E05Y 2201/654

USPC ..... 49/414, 375, 374, 349, 340, 352, 416, 49/332

See application file for complete search history.

(56) References Cited

U.S. PATENT DOCUMENTS

| | | | | |
|---|---|---|---|---|
| 5,528,861 | A * | 6/1996 | Beyerlein | E05F 11/485 49/349 |
| 5,809,695 | A * | 9/1998 | Strickland | E05F 11/488 49/352 |
| 7,802,401 | B2 * | 9/2010 | Wild | E05F 11/382 49/375 |
| 9,511,652 | B2 * | 12/2016 | Barr | B60J 5/0416 |
| 2002/0050100 | A1 * | 5/2002 | Tatsumi | E05F 11/385 49/375 |
| 2005/0011130 | A1 * | 1/2005 | Klippert | E05F 11/485 49/352 |

(Continued)

*Primary Examiner* — Chi Q Nguyen
(74) *Attorney, Agent, or Firm* — Brooks Kushman P.C.

(57) ABSTRACT

A window regulator may include a first guide rail assembly, that may be coupled to the door panel and including a first guide rail, a first pulley and a second pulley. The first slider may be configured to receive the window pane and translate along the first guide rail to move the window pane between an open position and a closed position. The first cable may be coupled to a drive and engaged with the first pulley and may be fixed to the first slider such that actuation of the drive moves the first slider and the window pane into the opening. The spring may be disposed between an end of the first cable and a portion of the first slider. The spring may be configured to bias the slider and an edge of the window pane towards the A-side beam or the B-side beam.

20 Claims, 3 Drawing Sheets

(56) References Cited

U.S. PATENT DOCUMENTS

| | | | | |
|---|---|---|---|---|
| 2006/0185248 | A1* | 8/2006 | Kollner | E05F 11/488 49/352 |
| 2007/0000178 | A1* | 1/2007 | Wild | E05F 11/382 49/352 |
| 2007/0180773 | A1* | 8/2007 | Fortin | E05F 15/689 49/352 |
| 2009/0000202 | A1* | 1/2009 | Eckhardt | E05F 11/385 49/352 |
| 2009/0090065 | A1* | 4/2009 | Kinoshita | E05F 11/485 49/352 |
| 2011/0016793 | A1* | 1/2011 | Gallois | E05F 11/488 49/352 |
| 2017/0370145 | A1* | 12/2017 | Koike | B60J 1/17 |

* cited by examiner

WINDOW REGULATOR ASSEMBLY

TECHNICAL FIELD

The present disclosure relates to a window regulator or lifter for use in a motor vehicle.

BACKGROUND

In recent years, at least in luxury vehicles, flush-mount pane designs ("flush glass" or "flush glazing") have increased in popularity. With such designs, in the closed position, the window pane is flush-mounted relative to upper and lateral body frame members, such as a roof rail, an A-side pillar, and/or a B-side pillar. The window opening formed from the rail and pillars is closed by the window pane.

SUMMARY

According to one embodiment, a vehicle door including a window regulator is provided. The vehicle door may be coupled to a vehicle body that includes a first pillar and a second pillar. As another example, the vehicle body may include the first pillar and the second pillar. The vehicle door may include a door panel, a first guide rail assembly including a first guide rail, coupled to the door panel, a first pulley and a second pulley, a first slider, a first cable, and a spring. The first and second pulleys may be rotatably coupled to the first guide rail. The first slider may be configured to receive a window pane and translate along the first guide rail to move the window pane between an open position and a closed position. The first cable may be coupled to a drive and engaged with a first pulley and fixed to the first slider such that actuation of the drive moves the slider and the window pane towards the closed position. The spring may be disposed between an end of the first cable and a portion of the first slider. The spring may be configured to bias the slider and an edge of the window pane towards the first pillar or the second pillar.

The first cable may include a first stop that may engage a first end of the spring. The spring may be configured to compress against the stop as the first slider receives the window pane.

The vehicle door may include a second guide rail assembly and a second slider. The second guide rail assembly may include a second guide rail that may be coupled to the door panel and disposed closer to the second pillar than the first guide rail assembly. The slider may be configured to receive the window pane and translate along the second guide rail to move the window pane between the open position and the closed position. The second slider may include a jaw that may be configured to receive the window pane in a force-fit manner.

In a pre-assembled state, before the window pane is fixed to the first slider and the second slider, the first slider is spaced apart from a belt line of the vehicle door by a first distance and the second slider is spaced apart from the belt line by a second distance, greater than the first distance. In an assembled state, after the window pane is fixed the first slider and the second slider, the first slider is spaced apart from a belt line of the vehicle door by a third distance, wherein the third distance is substantially equal to the second distance.

The vehicle door may include a second cable and a third cable. The second cable may be coupled to the drive and fixed to the second slider. The second cable may be configured to move the second slider and the window pane towards the closed position. The third cable may be coupled to the drive and fixed to the first slider and be configured to move the first slider and the window pane towards the open position.

The window pane may define a center of gravity. The first guide rail may be spaced apart from the center of gravity by a third distance and the second guide rail may be spaced apart from the center of gravity by a fourth distance. The fourth distance may be less than the third distance.

According to another embodiment, a window regulator configured to move a window pane into an opening defined by a door panel, an A-side beam, and a B-side beam, each extending from the door panel, is provided. The window regulator may include a first guide rail assembly, that may be coupled to the door panel and including a first guide rail, a first pulley and a second pulley. The first and second pulleys may each be rotatably coupled to the first guide rail. The first slider may be configured to receive the window pane and translate along the first guide rail to move the window pane between an open position and a closed position. The first cable may be coupled to a drive and engaged with the first pulley and may be fixed to the first slider such that actuation of the drive moves the first slider and the window pane into the opening. The spring may be disposed between an end of the first cable and a portion of the first slider. The spring may be configured to bias the slider and an edge of the window pane towards the A-side beam or the B-side beam.

The first guide rail may extend along a vertical axis and the spring may extend in a first direction that may be substantially transverse to the vertical axis.

The first cable may include a medial portion and a distal-end portion. The medial portion may extend in a second direction parallel to the vertical axis.

The distal-end portion may extend in a third direction substantially transverse to the vertical axis.

The distal-end portion of the first cable may be disposed within an inner periphery of the spring.

The window regulator may include an end cap that may be fixed to the distal-end portion of the first cable. The end cap may be configured to translate with respect to the first slider to compress the spring.

The window regulator may include a second guide rail assembly and a second slider. The second guide rail assembly may include a second guide rail configured to be coupled the door panel and disposed closer to the B-side beam than the first guide rail assembly. The second slider may be configured to receive the window pane and translate along the second guide rail to move the window pane from the cavity into the opening. The window pane may define a center of gravity. The first guide rail may be spaced apart from the center of gravity by a third distance and the second guide rail may be spaced apart from the center of gravity by a fourth distance. The fourth distance may be less than the third distance.

According to yet another embodiment, an integrated window regulator assembly is provided. The integrated window regulator may include a carrier plate, a first guide rail, a first pulley, a second pulley, a first slider, and a first cable. The first guide rail may extend from the carrier plate. The first pulley and the second pulley may each be rotatably coupled to the first guide rail. The first slider may be configured to receive the window pane and translate along the first guide rail to move the window pane between an open position and a closed position. The first cable may be coupled to a drive and engaged with the first pulley and fixed to the slider such that actuation of the drive moves the first slider and the window pane from the cavity into the opening. The integrated window regulator assembly may include a spring that may be disposed between an end of the first cable and the first slider. The spring may be configured to bias the first slider and an edge of the window pane towards the A-side beam or the B-side beam.

The first slider may include a main portion and a sleeve extending therefrom. The spring may be disposed in the sleeve.

The first guide rail may extend in a longitudinal direction and the sleeve may extend in a direction that is parallel to the longitudinal direction.

The main portion may include a first jaw and a second jaw, opposing the first. The first jaw and the second jaw may be spaced apart to receive the window pane.

MOM As the drive is actuated to move the window pane, the spring may bias the first slider towards the opening.

The spring may be a helical compression spring.

The integrated window regulator assembly may include a second guide rail and a second slider. The second guide rail may extend from the carrier plate and be disposed closer to the B-side beam than the first guide rail. The second slider may be configured to receive the window pane and translate along the second guide rail to move the window pane into the opening. The window pane may define a center of gravity. The first guide rail may be spaced apart from the center of gravity by a first distance and the second guide rail may be spaced apart from the center of gravity by a second distance. The second distance may be less than the first distance.

DETAILED DESCRIPTION

Figure 1:
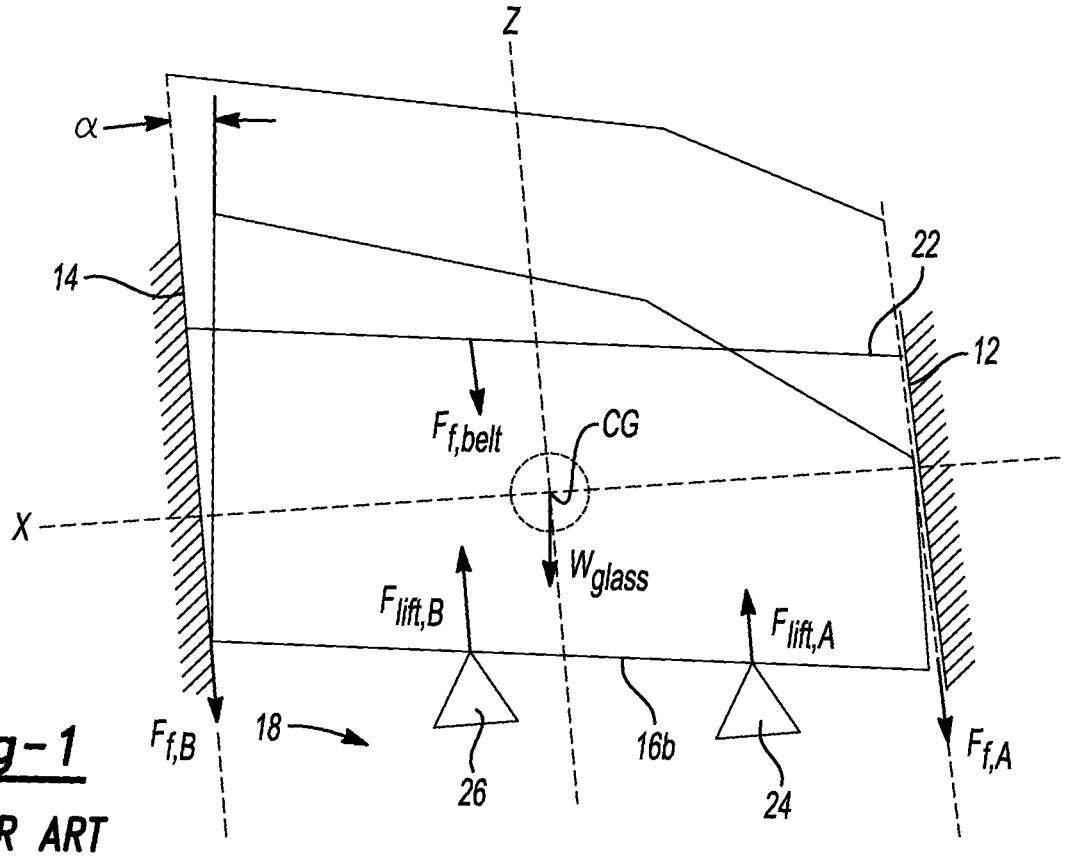
Fig-1 PRIOR ART
FIG. 1 is a schematic representation of a free-body diagram of a prior-art window regulator configured to move a window pane from an open position to a closed position.

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

The term "substantially" or "about" may be used herein to describe disclosed or claimed embodiments. The term "substantially" or "about" may modify a value or relative characteristic disclosed or claimed in the present disclosure. In such instances, "substantially" or "about" may signify that the value or relative characteristic it modifies is within ±0%, 0.1%, 0.5%, 1%, 2%, 3%, 4%, 5% or 10% of the value or relative characteristic.

The term "couple" or "coupled" may be used herein to describe disclosed or claimed embodiments. The term "couple" or "coupled" may refer to fasten, link, or associate one object with another, either directly or indirectly.

Although the terms first, second, third, etc. may be used to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Flush-mount panes may present one or more challenges for creating a sufficient seal between the body frame members and the window pane. A window pane in a traditional vehicle door generally engage side pillars and an upper pillar that are defined by the vehicle door, as opposed to a vehicle with flush-mount panes. As will be described in greater detail below, because the window pane is not guided by the side pillars, the window pane may inadvertently shift or tilt towards the front or the rear of the vehicle, causing a gap between the window pane and the side pillars.

The present disclosure aims to provide one or more solutions to at least the problem mentioned above.

Referring generally to the figures, a vehicle door or portions of a vehicle body 10 including a first pillar 12, a second pillar 14, and a window pane 16, is provided. The vehicle door 10 may include an integrated window regulator assembly 18 provided with a carrier plate 100, a first guide rail assembly 102, and a second guide rail assembly 106. The first guide rail assembly 102 may be provided with a first guide rail 104, extending from the carrier plate 100. A first pulley 110 and a second pulley 112 may each be rotatably coupled to the first guide rail 104. A first slider 114 may be configured to receive the window pane 16 and translate along the first guide rail 104 to move the window pane 16 between an open position to a closed position.

The integrated window regulator assembly 101 may include a first cable, such as a cross cable 118, that may be coupled to a drive 120 and fixed to the first slider 114. The first cable 118 may engage the first pulley 110 so that a portion of the first cable 118, fixed to the first slider, extends along a longitudinal axis 122 defined by the first guide rail 104. The first cable 118 may also be referred to as a cross cable. A spring 124 may be disposed between an end of the first cable 118 and the first slider 114 to bias the first slider 114 and an edge 16*a* of the window pane towards either the first pillar 12 or the second pillar 14. In one or more embodiments, the spring 124 may be a helical compression spring and the first cable 118 may extend through the spring 124 and include an end cap 126 that may engage a first end 121 of the spring 124. The spring 124 may compress against the stop 126 as the window pane 16 is received by the first slider 114.

The second guide rail assembly 106 includes a second guide rail 108, extending from the carrier plate 100, and a second slider 116 configured to receive the window pane 16 and translate along the second guide rail 108 to move the window pane 16 between open and closed positions. In one or more embodiments, the second slider 116 may include a jaw that may be configured to receive the window pane 16 in a force-fit manner. In a pre-assembled state, before the window pane 16 is fixed to the first and second sliders 114, 166, the first slider 114 may be positioned closer to a belt line 22 than the second slider 116. For example, the first slider 114 may be spaced apart from the belt line 22 by a first distance D1 and the second slider 116 is spaced apart from the belt line by a second distance D2, that may be greater than the first distance D1. In an assembled state, after the window pane 16 is fixed to the first slider 114 and the second slider 116, the first slider 114 may be displaced such that it is spaced apart from the belt line 22 by a third distance, that is substantially equal to the second distance D2.

The first pillar 12 may be referred to as an A-side pillar and the second pillar 14 may be referred to as a B-side pillar. The A-side pillar may be positioned closer to the front of the vehicle than the B-side pillar.

FIG. 1 illustrates a free-body diagram of a prior-art window regulator moving a window pane to the closed position. An opening formed in the door panel 20 may be defined by a belt line 22 that may extend between the A-side pillar 12 and the B-side pillar 14. The window pane may move through the opening defined by the belt line 22. Friction between the belt line 22 and the window pane 16 may create a downward force $F_{belt}$ on the window pane 16 as the window pane 16 moves towards the closed position.

A first lift point 24, disposed between the A-side pillar 12 and the center of gravity CG, may be provided by a slider that translates along a guide rail (not shown). A second lift point 26, disposed between the B-side pillar 14 and the center of gravity CG, may be provided by a slider that translates along a second guide rail (not shown). Because the first lift point 24 is positioned closer to the center of gravity CG of the window pane 16 than the second lift point 26, an edge 16*a* of the window pane 16 may move away from the A-side pillar 12 by an angle α. The angle α may vary or fluctuate, e.g., increase or decrease because of tolerances and part quality.

As the angle α increases the distance between a bottom edge 16*b* of the window pane 16 and the first lift point 24 may increase. If the distance between the bottom edge 16*b* of the window pane 16 and the first lift point 24 increases beyond a predetermined threshold, fixing the bottom edge 16*b* of the window pane 16 to the device that defines the first lift point 24, such as a first slider 114, may not be possible or may require significant time and effort. If the first slider 114 includes a force-fit attachment device, requiring relatively tighter tolerances than another attachment device, such has a fastener, the problem of attaching the window pane 16 to the first slider may be exaggerated further.

Figure 2:
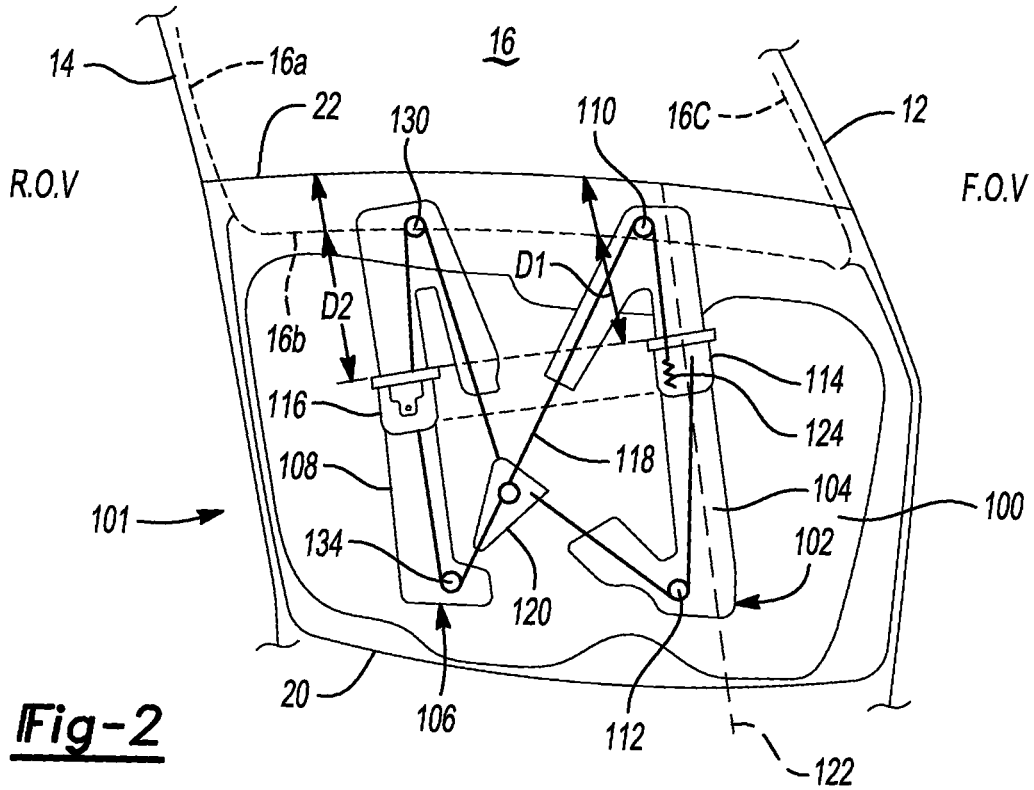
FIG. 2 is a partial-plan view of an exemplary window regulator assembly disposed within a vehicle.

FIG. 2 illustrates a partial-plan view of an integrated window regulator assembly 101, according to one or more embodiments, attached to the vehicle door panel 20 and provided with the window pane 16. Here, the vehicle body includes the A-side pillar 12 and the B-side pillar 14 and the door panel 20 is disposed therebetween. The A-side pillar 12 may be disposed closer to a front of the vehicle (F.O.V.) and the B-side pillar 14 may be disposed closer to the rear of the vehicle (R.O.V.). A portion of the window pane 16 is represented by dashed lines 16*a*, 16*b*, and 16*c*.

As mentioned above, the integrated window regulator assembly 101 may include a first guide rail assembly 102 and a second guide rail assembly 106, each including a first guide rail 104 and a second guide rail 108, respectively. In one or more embodiments, the first guide rail 104 may be formed integrally with the carrier plate 100. For example, the carrier plate 100, the first guide rail 104, and the second guide rail 108 may each be formed of a polymeric material by injection molding. As another example, each of the guide rails 104, 108 may be formed of metal, such as steel or another suitable alloy, and fixed to the carrier plate 100 by over-molding or by one or more threaded fasteners.

The first guide rail assembly 102 may include first and second pulleys 110, 112 each pivotally coupled to the first guide rail 104. The second guide rail assembly 106 may include third and fourth pulleys 130, 134 each pivotally coupled to the second guide rail 108. The cross cable 118 includes a first end, that extends from the drive 120 to a middle portion that is at least partially wound around the first pulley 110, and a second end that is coupled to the first slider 114 and the spring 124. Second and third cables, such as an upper cable 136 and a lower cable 138 may be provided. The upper cable 136 may be fixed to the second slider 116 and configured to move the second slider 116 and the window pane 16 towards the closed position. The lower cable 138 may be coupled to the drive and fixed to the first slider 114 such that the lower cable 138 moves the first slider 114 and the window pane 16 towards the open position.

In FIG. 2, the first slider 114 and the second slider 116 are each illustrated in a middle position. The first and second sliders 114, 116 may be disposed in the middle position in a pre-assembled state, before the window pane 16 is attached to the first and second sliders. In the pre-assembled state, the first slider 114 may be disposed closer to the belt line 22 or upper portions of the guide rail 104, than the second slider 116. For example, the first slider 114 may be spaced apart from the belt line 22 by a first distance D1 and the second slider 116 may be spaced apart from the belt line 22 by a second distance D2, less than the first distance D1. As the window pane 16 is attached to the first and second sliders 114, 116, the spring 124 may compress and the first slider 114 may move in a downward direction so that it is parallel to the second slider 116. In other words, the first slider 114 and the second slider 116 may be spaced apart from the belt line 22 by the same distance when the window pane 16 is attached to the sliders 114, 116 in the assembled state. When the sliders 114, 116 are in a bottom position, adjacent to the second and fourth pulleys 112, 134, the window pane 16 may be in the fully opened position. When the sliders 114, 116 are in a top position, the first and third pulleys 110, 130, the window pane 16 may be in the fully closed position.

Figure 3:
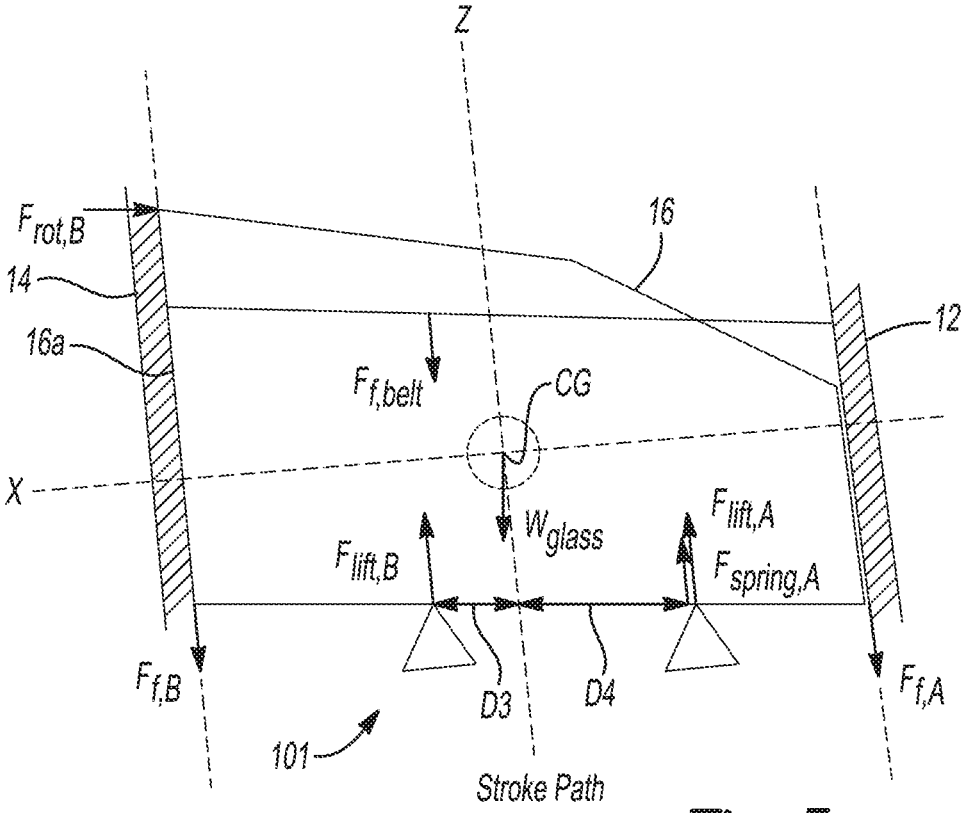
FIG. 3 is a schematic representation of a free-body diagram of the exemplary window regulator assembly, illustrated in FIG. 2, moving a window pane in an upward direction form an open position towards a closed position.
Figure 4:
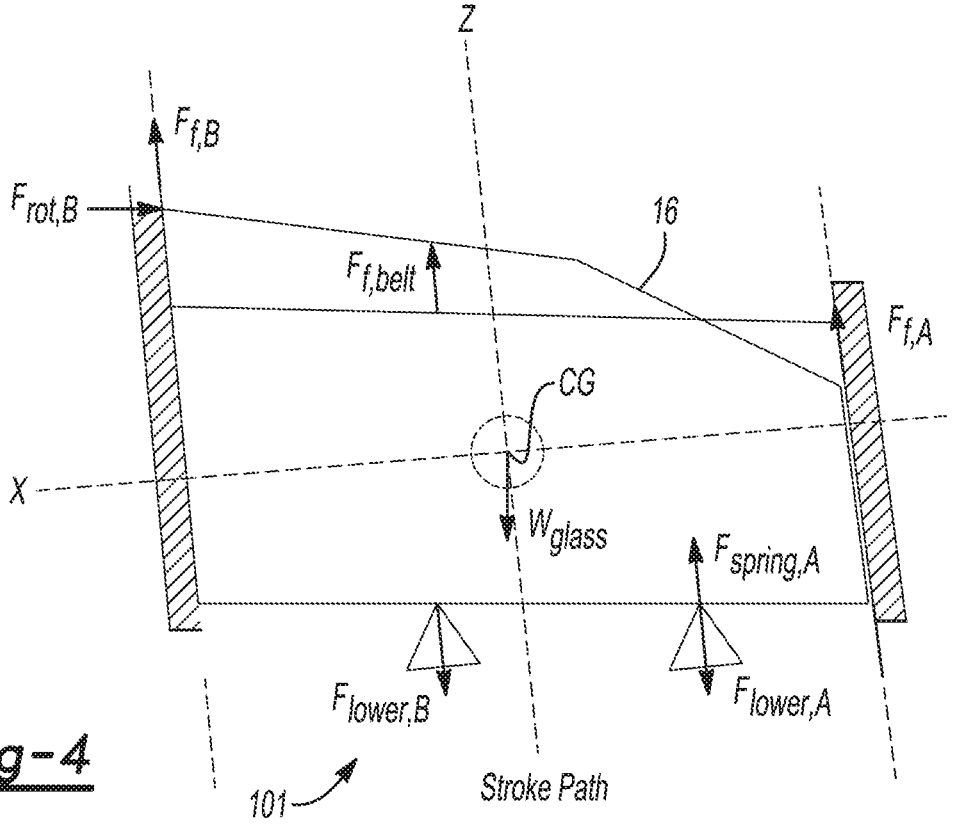
FIG. 4 is a schematic representation of a free-body diagram of the exemplary window regulator assembly, illustrated in FIG. 2, moving a window pane in a downward direction from a closed position towards an open position.

FIG. 3 illustrates a schematic view of a free-body diagram of the integrated window regulator assembly 101 moving the window pane 16 towards the closed position. FIG. 4 illustrates a schematic view of a free-body diagram of the integrated window regulator assembly 101 moving the window pane 16 towards the open position. The window pane 16 may define a center of gravity (CG) and first guide rail assembly and the second guide rail assembly may each be disposed on either side of the center of gravity. The first guide rail assembly and the second guide rail assembly each form lifting points $F_{lift,A}$ and FLAB. The lifting point $F_{lift,B}$ of the second guide rail assembly 106 may be spaced apart from the center of gravity CG by a third distance D3 and the lifting point FA of the first guide rail assembly 102 may be spaced apart from the center of gravity CG by a fourth distance D4, that may be greater than the third distance D3.

Friction between the window pane 16 and the A-side pillar 12 is represented by the directional arrow labeled $F_{f,A}$, friction between the window pane and the B-side pillar 14 is represented by the directional arrow labeled $F_{f,3}$, and friction between the window pane 16 and the belt line 22 is represented by the directional arrow labeled $F_{f,belt}$. The spring 124 generates a force $F_{spring}$, A in the vertical direction to bias the edge 16*a* of the window pane towards the A-side pillar 12. A reactionary force $F_{rot,B}$ is generated in response to the edge 16*a* of the window pane being pressed against the B-side pillar 14. As illustrated in FIG. 4, the spring 124 generates the force $F_{spring,\ A}$ in the vertical direction as the window pane 16 is lowered towards the open position.

Figure 5:
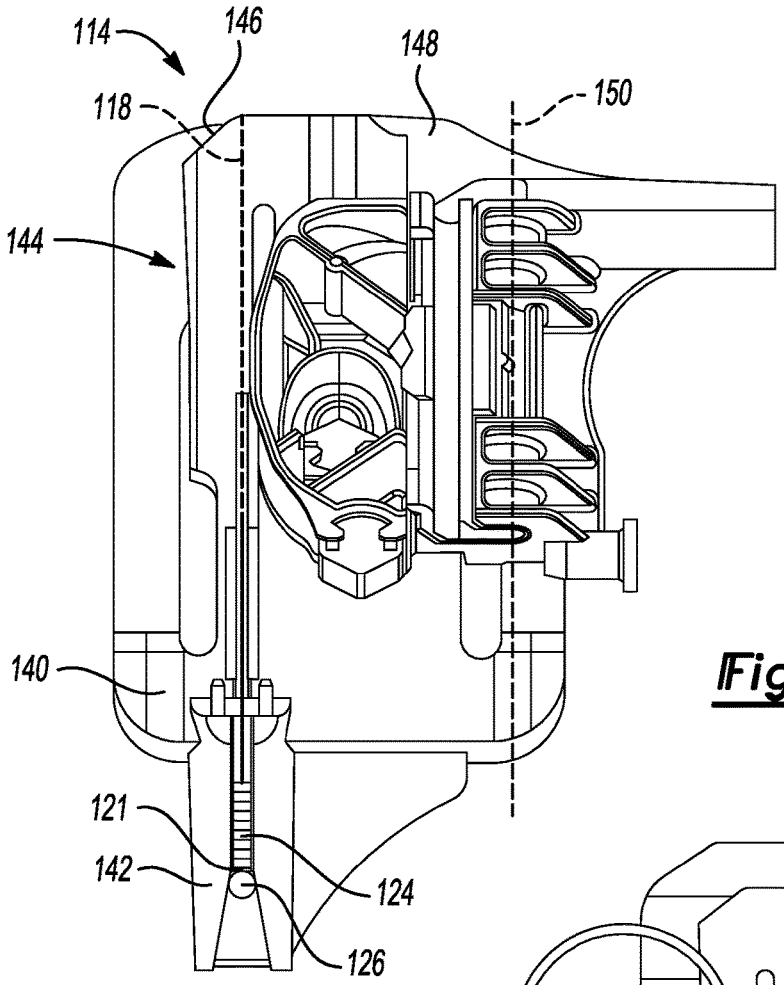
FIG. 5 is a plan view of an exemplary slider and cable according to one embodiment.

FIG. 5 illustrates a plan view of the first slider 114 according to one or more embodiments. The first slider 114 may include a main body portion 140 and a sleeve 142 extending therefrom. In one or more embodiments, the sleeve 142 and cross cable 118 may extend in a direction that is parallel to a travel axis 150. The travel axis 150 may be the axis that the first slider moves e.g. translate along the first guide rail 104. The spring 124 may be housed within the sleeve 142 and the spring may be retained by an end cap 126 disposed at an end of the cross cable 118. A portion of the sleeve 142 may be sized to act as a stop by engaging an upper portion of the spring 124 such that as a force is applied to the lower portion of the spring, by the end cap 126.

As mentioned above, the first slider 114 may form a jaw 144 configured to engage the window pane 16. The jaw 144 may be formed by a first jaw member 146 and a second jaw member 148 each extending from the main body portion 140. The first jaw member 146 and the second jaw member 148 may be spaced apart such that the first jaw member 146 and the second jaw member 148 form a force-fit condition with the window pane 16. The first slider 114 may include a recessed portion configured to engage the first guide rail 104.

Figure 6:
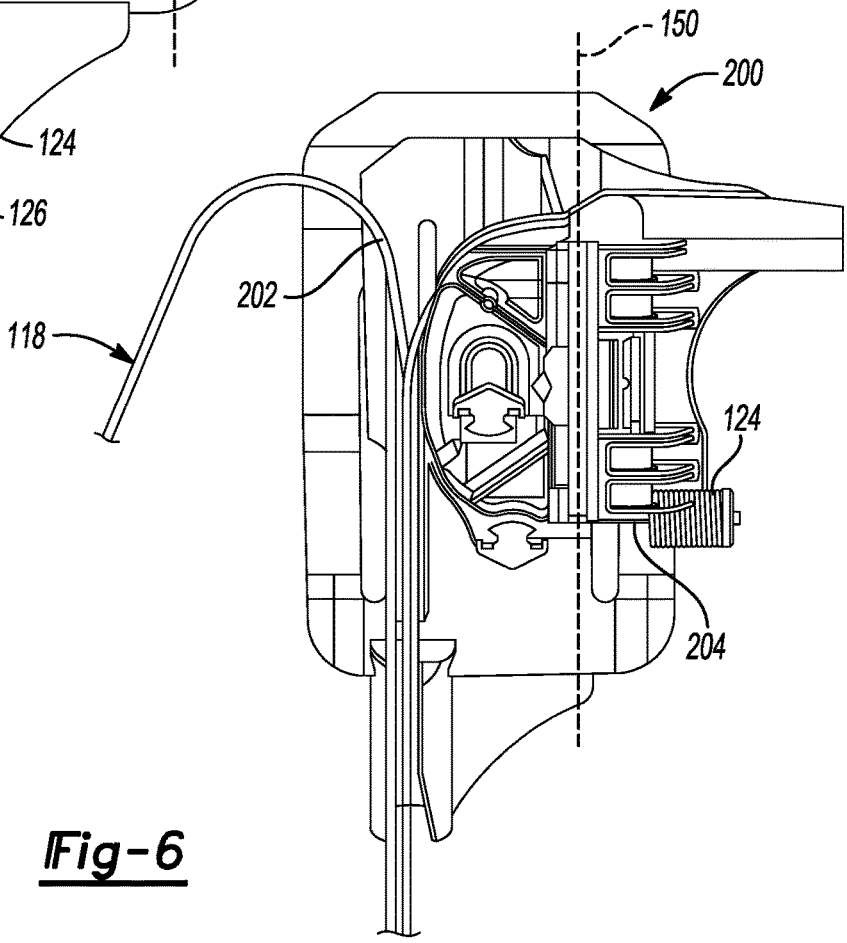
FIG. 6 is a plan view of another exemplary slider and cable according to one embodiment.

FIG. 6 illustrates a plan view of another first slider 200 according to one or more embodiments. Here, the cross cable 118 includes a medial portion 202 and a distal-end portion 204. The medial portion 202 of the cross cable 118 may extend in a vertical direction, such as a direction that is parallel to the travel axis 150. The distal-end portion 204 of the cross cable 118 may extend in a direction that is substantially transverse the travel axis 150 and terminate at an end cap 206. The end cap 206 may engage a first end of the spring 124 such that the force $F_{spring}$ of the spring 124 is translated through the slider 200 and the medial portion 202 of the cross cable 118.

As mentioned above, because the window pane is not guided by the side pillars, the window pane may inadvertently shift or tilt towards the front or the rear of the vehicle, causing a gap between the window pane and the side pillars. The direction the window shifts, or tilts may be associated with the center of gravity of the window in relation to the first slider 114. As the first slider 114 moves the window pane 16 towards the closed position, the spring 124 may provide additional force to counteract the force associated with the weight of the window pane 16 to move the edge of the window pane 16 towards one of the side pillars.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

Parts List

The following is a list of reference numbers shown in the Figures. However, it should be understood that the use of these terms is for illustrative purposes only with respect to one embodiment. And, use of reference numbers correlating a certain term that is both illustrated in the Figures and present in the claims is not intended to limit the claims to only cover the illustrated embodiment.

10 vehicle door
12 A-side pillar
14 B-side pillar
16 window pane
18 window regulator assembly
20 vehicle door panel
22 belt line
24 first lift point
26 second lift point
100 carrier plate
101 window regulator assembly
102 first guide rail assembly
104 first guide rail
106 second guide rail assembly
108 second guide rail
110 first pulley
112 second pulley
114 first slider
116 second slider
118 cross cable
120 drive
121 first end
122 longitudinal axis
124 spring
126 end cap
130 third pulleys
134 fourth pulleys
136 upper cable
138 cable
140 main body portion
142 sleeve
144 jaw
146 first jaw member
148 second jaw member
150 travel axis
166 second sliders
16*a* edge

16*a* lines
16*b* lines
16*b* bottom edge
16*c* lines
200 slider
200 first slider
202 medial portion
204 distal-end portion
206 end cap

What is claimed is:

1. A vehicle door provided with a first pillar and a second pillar, the vehicle door comprising:

a door panel;

a first guide rail assembly including a first guide rail, coupled to the door panel, a first pulley and a second pulley, wherein the first pulley and the second pulley are each rotatably coupled to the first guide rail;

a first slider configured to receive a window pane and translate along the first guide rail to move the window pane between an open position and a closed position;

a first cable coupled to a drive and engaged with the first pulley and fixed to the first slider such that actuation of the drive moves the first slider and the window pane towards the closed position; and a spring disposed between an end of the first cable and a portion of the first slider, wherein the spring is configured to bias the first slider and an edge of the window pane towards the first pillar or the second pillar.

2. The vehicle door of claim 1, wherein the first cable includes a stop wherein the stop engages a first end of the spring and wherein the spring is configured to compress against the stop as the as the first slider receives the window pane.

3. The vehicle door of claim 1, further comprising:

a second guide rail assembly including a second guide rail, coupled to the door panel and disposed closer to the second pillar than the first guide rail assembly; and a second slider configured to receive a window pane and translate along the second guide rail to move the window pane between the open position and the closed position, wherein the second slider includes a jaw configured to receive the window pane.

4. The vehicle door of claim 3, wherein in a pre-assembled state, before the window pane is fixed to the first slider and the second slider, the first slider is spaced apart from a belt line of the vehicle door by a first distance and the second slider is spaced apart from the belt line by a second distance, greater than the first distance, and wherein in an assembled state, after the window pane is fixed the first slider and the second slider, the first slider is spaced apart from a belt line of the vehicle door by a third distance, wherein the third distance is substantially equal to the second distance.

5. The vehicle door of claim 3, further comprising:

a second cable coupled to the drive and fixed to the second slider, wherein the second cable is configured to move the second slider and the window pane towards the closed position; and a third cable coupled to the drive and fixed to the first slider, wherein the third cable is configured to move the first slider and the window pane towards the open position.

6. The vehicle door of claim 5, wherein the window pane defines a center of gravity, wherein the first guide rail is spaced apart from the center of gravity by a fourth distance and the second guide rail is spaced apart from the center of gravity by a fifth distance, wherein the fourth distance is less than the fifth distance.

7. A window regulator configured to move a window pane into an opening defined by a door panel, an A-side beam, and a B-side beam, wherein the A-side beam and the B-side beam each extend from the door panel or formed by portions of a vehicle body, the window regulator comprising:

a first guide rail assembly configured to be coupled to the door panel and including a first guide rail, a first pulley and a second pulley, wherein the first pulley and the second pulley are each rotatably coupled to the first guide rail;

a first slider configured to receive the window pane and translate along the first guide rail to move the window pane between an open position and a closed position;

a first cable coupled to a drive and engaged with the first pulley and fixed to the first slider such that actuation of the drive moves the first slider and the window pane into the opening; and a spring disposed between an end of the first cable and a portion of the first slider, wherein the spring is configured to bias the first slider and an edge of the window pane towards the A-side beam or the B-side beam.

8. The window regulator of claim 7, wherein the first guide rail extends along a vertical axis, wherein the spring extends in a first direction substantially transverse to the vertical axis.

9. The window regulator of claim 8, wherein the first cable includes a medial portion and a distal-end portion, wherein the medial portion extends in a second direction parallel to the vertical axis.

10. The window regulator of claim 9, wherein the distal-end portion extends in a third direction substantially transverse to the vertical axis.

11. The window regulator of claim 10, wherein the distal-end portion of the first cable is disposed within an inner periphery of the spring.

12. The window regulator of claim 11, further comprising an end cap fixed to the distal-end portion of the first cable, wherein the end cap is configured to translate with respect to the first slider to compress the spring.

13. The window regulator of claim 7, further comprising:

a second guide rail assembly including a second guide rail, configured to be coupled to the door panel disposed closer to the B-side beam than the first guide rail assembly; and a second slider configured to receive the window pane and translate along the second guide rail to move the window pane into the opening, wherein the window pane defines a center of gravity, wherein the first guide rail is spaced apart from the center of gravity by a first distance and the second guide rail is spaced apart from the center of gravity by a second distance, wherein the second distance is less than the first distance.

14. An integrated window regulator assembly to move a window pane into an opening defined by a door panel, an A-side beam, and a B-side beam, each extending from the door panel, the integrated window regulator comprising:

a carrier plate;

a first guide rail extending from the carrier plate;

a first pulley and a second pulley, wherein the first pulley and the second pulley are each rotatably coupled to the first guide rail;

a first slider configured to receive the window pane and translate along the first guide rail to move the window pane between an open position and a closed position;

a first cable coupled to a drive and engaged with the first pulley and fixed to the first slider such that actuation of the drive moves the first slider and the window pane into the opening; and a spring disposed between an end of the first cable and the first slider, wherein the spring is configured to bias the first slider and an edge of the window pane towards the A-side beam or the B-side beam.

15. The integrated window regulator assembly of claim 14, wherein the first slider includes a main portion and a sleeve extending therefrom, wherein the spring is disposed in the sleeve.

16. The integrated window regulator assembly of claim 15, wherein the first guide rail extends in a longitudinal direction and wherein the sleeve extends in a direction parallel to the longitudinal direction.

17. The integrated window regulator assembly of claim 14, wherein as the drive is actuated to move the window pane, the spring biases the first slider towards the opening.

18. The integrated window regulator assembly of claim 14, wherein the spring is a helical compression spring and the first cable extends through the spring with an end cap of the first cable contacting the first end of the spring.

19. The integrated window regulator assembly of claim 14, further comprising:

a second guide rail extending from the carrier plate and disposed closer to the B-side beam than the first guide rail; and a second slider configured to receive the window pane and translate along the second guide rail to move the window pane into the opening, wherein the window pane defines a center of gravity, wherein the first guide rail is spaced apart from the center of gravity by a first distance and the second guide rail is spaced apart from the center of gravity by a second distance, wherein the second distance is less than the first distance.

20. The integrated window regulator assembly of claim 14, wherein the spring has a first end connected to the end of the first cable and a second end connected to the first slider, wherein the spring is further configured to bias the first slider in an upward vertical direction.

* * * * *